United States Patent [19]

Miller

[11] Patent Number: 4,858,325

[45] Date of Patent: Aug. 22, 1989

[54] CHAIN SAW AND GUIDE

[76] Inventor: Edward A. Miller, P.O. Box 617, Woodstock, Ga. 30188

[21] Appl. No.: 69,171

[22] Filed: Jul. 2, 1987

[51] Int. Cl.[4] ..... B27B 17/02

[52] U.S. Cl. ..... 30/373; 30/383

[58] Field of Search ..... 30/371, 373, 374, 383–387

[56] References Cited

U.S. PATENT DOCUMENTS

| | | | |
|---|---|---|---|
| 2,698,034 | 12/1954 | Jakku | 30/371 |
| 2,779,359 | 1/1937 | Koski | 30/371 |
| 3,051,203 | 8/1962 | Hayden | 143/32 |
| 3,864,830 | 2/1975 | Haddon | 30/371 |
| 4,146,962 | 4/1979 | Grube | 30/371 |
| 4,173,240 | 11/1979 | Boyce | 144/312 |

*Primary Examiner*—Douglas D. Watts

*Attorney, Agent, or Firm*—Thomas & Kennedy

[57] ABSTRACT

The chain saw and guide assembly 10 includes two pairs of guide plates 14 and 15 mounted to the guide bar 12. The pairs of guide plates are spaced from each other and are used to engage guide surfaces (FIGS. 5, 6 and 8) as the center span of the saw chain 13 cuts a work product.

8 Claims, 3 Drawing Sheets

CHAIN SAW AND GUIDE

BACKGROUND OF THE INVENTION

This invention relates in general to a hand held, portable self driven chain saw of the type used to cut wood. More particularly, the invention relates to a chain saw with a guide attachment mounted to the chain bar which extends beyond the saw chain and shields the saw chain so that the guide can engage a guiding surface as the unshielded portion of the saw chain cuts a work product.

Chain saws have been utilized for rough cutting purposes where the relatively unskilled operator can cut. The advantages of the chain saw include portability, ease of handling in various attitudes and rapid cutting action. Although the above noted advantages of the chain saw make it a highly useful cutting tool in rough cut situations, the chain saw is not very useful by the average operator when very accurate cuts in a wood product must be made.

For example, the fact that the chain saw is hand held by its operator and is a relatively large, heavy and cumbersome tool usually prevents the operator from making accurate cuts as would be required when building rustic furniture, log cabins and other objects which could be formed by a chain saw if the saw could be accurately manipulated during its cutting function.

A few guide devices have been conceived in the past which assist the chain saw operator in handling the chain saw when making relatively accurate cuts. For example, U.S. Pat. Nos. 3,051,203, 3,864,830 and 4,173,240 disclose attachments that can be fastened to chain saws and which engage a work product or an attachment to the work product and guide the saw chain during its cutting function. However, these prior art chain saw guide attachments appear to be relatively large and cumbersome and difficult to attach to and remove from the saw or the work product.

SUMMARY OF THE INVENTION

Briefly described, the present invention comprises a chain saw and guide which permits the chain saw operator to accurately use the chain saw when cutting wooden objects. The chain saw comprises the conventional chain saw assembly, including the chain bar, cutting chain that moves about the perimeter of the chain bar, and the motor, typically a gasoline powered engine that drives the saw chain. Guides are mounted to the chain bar and the guides extend beyond the path of the saw chain so as to shield the saw chain at one or more positions extending along the length of the chain bar. The guides can be moved into engagement with a guide surface of a fixture or template so that the saw chain cuts in a path that corresponds to the shape of the surface of the fixture or template.

The guides protrude a predetermined distance beyond the cutting path of the saw chain, and the guides extend for the same predetermined distance on opposite sides of the cutting path of the saw chain so that when the chain saw is oriented in any attitude, it will cut a predetermined distance from the fixture or template against which it engages.

Thus, it is an object of this invention to provide a chain saw and guide whereby one or more of the guides which are mounted to the chain bar of the saw can be used to engage guiding surfaces of a fixture or template positioned on one or both sides of the work product and cause the saw chain to cut the work product to a depth that corresponds to the shape of the fixture or templates guiding surfaces.

Another object of this invention is to provide an inexpensive, simply constructed and easily attachable guide attachment for a conventional chain saw which, when used with two guide surfaces of a fixture or template positioned adjacent a work product, enables the operator of the chain saw to make more accurate cuts with the saw in the work product.

Another object of this invention is to provide a chain saw and guide which is easy to operate by a relatively unskilled operator and allows the operator to make accurate cuts in work products.

Another object of this invention is to provide a portable chain saw or similar apparatus that includes an exposed cutting chain or the like, with guide elements attached to the device that extend beyond the cutting chain and which function to engage a guiding surface of a fixture or template which will guide the cutting chain with respect to a profile of the guide surface of the fixture or template.

Other objects, features and advantages of this invention will become apparent upon reading the following specification, when taken in conjunction with the accompanying drawings.

DETAILED DESCRIPTION

Figure 1:
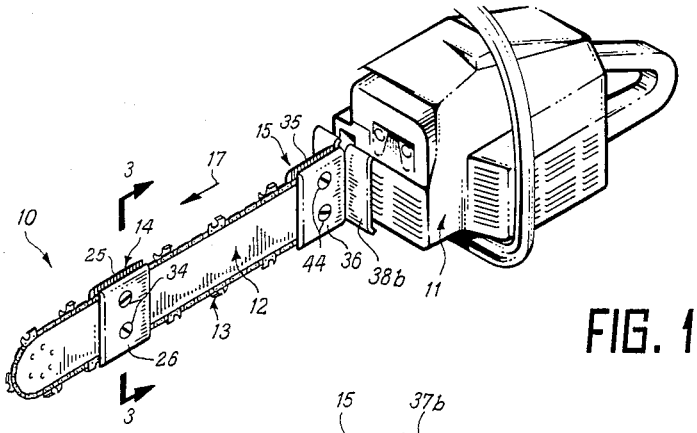
FIG. 1 is a perspective view of the chain saw and guide.

Referring now in more detail to the drawings, in which like numerals indicate like parts throughout the several views, FIG. 1 illustrates the chain saw and guide 10 which includes a motor housing 11 in which the gasoline engine (not shown) is enclosed, the chain bar 12 which extends from the motor housing 11, the saw chain 13 which extends about the periphery of the chain bar, and the pairs of guide plates 14 and 15 which are rigidly mounted to the chain bar 12. The gasoline engine (not shown) within the motor housing 11 drives the saw chain in the direction as indicated by arrow 17.

Figure 3:
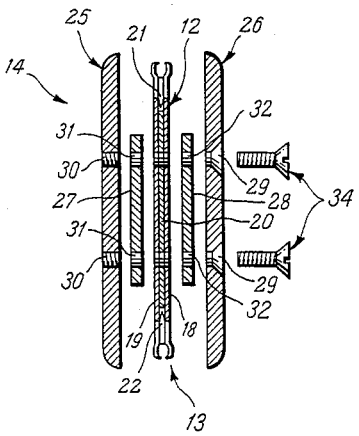
FIG. 3 is an exploded end view of the chain bar, taken along lines 3—3 of FIG. 1.

As illustrated in FIG. 3, the chain bar 12 comprises a pair of chain bar plates 18 and 19, with a spacer plate 20 positioned between the chain bar plates, with the spacer plate being smallar in length and width than the chain bar plates so that a chain guide or groove 21 is formed around the perimeter of the chain bar plates. The saw chain 13 includes a plurality of protrusions 22 that extend into the chain groove of the chain bar, and function to hold the saw chain on the perimeter of the chain bar as the saw chain moves. This is conventional in the prior art.

Figure 2:
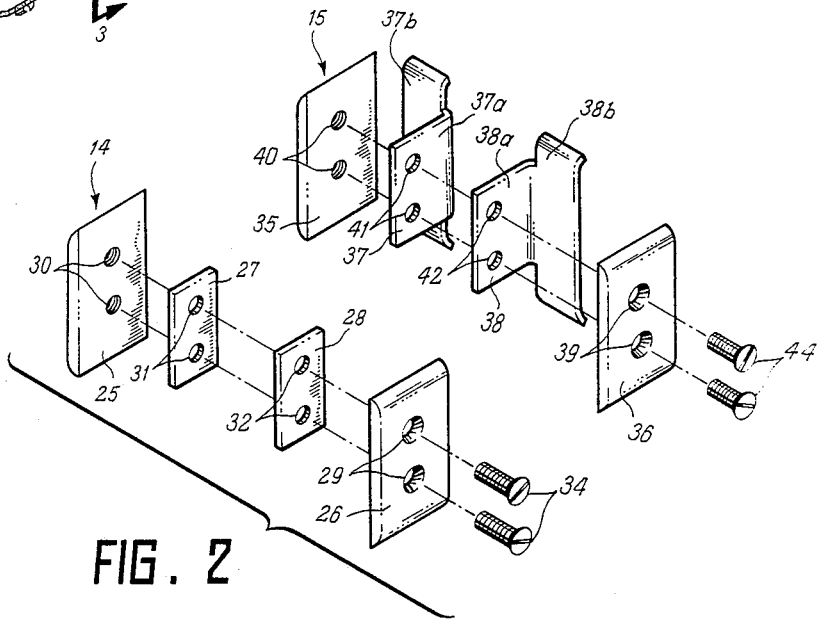
FIG. 2 is an exploded perspective illustration of the guide.

As illustrated in FIGS. 2 and 3, the guide assembly for the chain saw comprises two pairs of guide plates 14 and 15. The pair of guide plates 14 is mounted to the distal end of the chain bar 12, while the pair of guide plates 15 is mounted to the proximal end of the chain bar.

The pair of guide plates 14 includes guides plates 25 and 26 that are positioned on opposite sides of chain bar 12, and spacer plates 27 and 28 that are positioned between each guide plate 25 and 26, respectively, and chain bar 12. Beveled openings 29 are formed through guide plate 26, while threaded openings 30 are formed through guide plate 25. Spacer plates 27 and 28 also include openings 31 and 32. Similar openings are formed through chain bar 12 (FIG. 3). The openings of the chain bar as well as the openings 29, 30, 31 and 32 of the guide plates and spacer plates 25–28 are aligned with one another, and connector screws 34 extend through the openings to rigidly mount the guide plates and spacer plates to the chain bar. The helical screw threads of the connector screws 34 engage the helical threads formed in the openings 30 of guide plate 25. With this arrangement, the heads of the connectors screws lie flush with the surface of the guide plate 26, and the distal end portions of the connector screws do not protrude beyond the plane of the opposite guide plate 25.

The guide plates 35 and 36 are substantially identical to the guide plates 25 and 26, and include tapered openings 39 and threaded openings 40. Spacer plates 37 and 38 also include openings 41 and 42, with the connector screws 44 extending through the aligned openings 39, 40, 41 and 42 and through aligned openings in the chain bar (not shown) to rigidly mount the pair of guide plates to the chain bar. Spacer plates 37 and 38 comprise the spacer panels 37*a* and 38*b*, and each also includes a fender 37*b* and 38*b* which extends at a right angle with respect to its spacer panel 37*a* and 38*a*. The fenders 37*b* and 38*b* protrude out from the side edge of the guide plate 35 and 36 in front of the motor housing 11. If appropriate, a hole (not shown) can be formed in one of the fenders 37*b* or 38*b* for alignment with the adjusting screw of the saw which maintains proper operating tension on the cutting chain by repositioning the chain bar.

Figure 4:
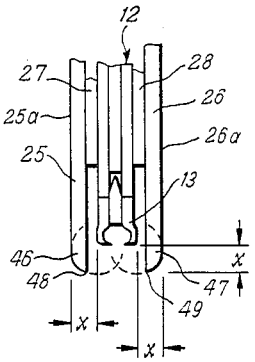
FIG. 4 is a detail illustration of a portion of the chain bar and of the guide, showing the dimensions of the guide.

As illustrated in FIG. 4, each guide plate of both pairs of guides have rounded edge portions 46 and 47 which protrude beyond the path of travel of the saw chain 13 and have the centers of their radii at the adjacent portion of the saw chain 13. The longitudinal edges 48 and 49 are located a predetermined distance X from the effective cutting path of the saw chain 13. Likewise, the total thicknesses of the spacer plates 27 and 28 and of the guide plates 25 and 26 on each side of the chain bar are such that the outer surfaces 25A and 26A of the guide plates 25 and 26, respectively, are located in planes that are displaced from the effective cutting path of the saw chain 13 the same predetermined distances X. Likewise, the longitudinal edges of the other pair of guide plates 15 are similarly designed.

The upper edges of the guide plates 25, 26, 35 and 36 extend about the return flight of the saw chain 13 and have longitidinal edges adjacent the saw chain path, with the edge portions of the guide plates extending beyond the cutting path of the saw chain. Although the saw usually is used to cut downwardly or laterally with the lower flight of the saw chain, there are times when the operator will want to cut in an upward direction and will use the upper flight of the saw chain. The upper edges of the guides 14 and 15 can be used for guiding the cutting path of the upper flight of the saw chain. Usually the upper edge portions of the guides will be left with right angle edges (not shown), and on some occasions the width of the guides will not precisely match the width of the chain bar, causing the upper edges of the guides to extend further beyond the cutting path of the upper flight of the saw chain than the distance X which is illustrated in FIG. 4. In some cases, the purchaser of the guides might choose to reshape the upper edges of the guides as illustrated in FIG. 3, so that the upper edges are of the same shape and proportions as the lower edges and the saw can be used, both top and bottom edges, to form similar cuts. However, some operators might prefer to have a different distance of guide plate overhang along the upper cutting flight of the saw chain than the lower cutting flight of the saw chain. This can be made available to the operator by purchasing different sized guide plates or by modifying the guide plates in the field.

Figure 5:
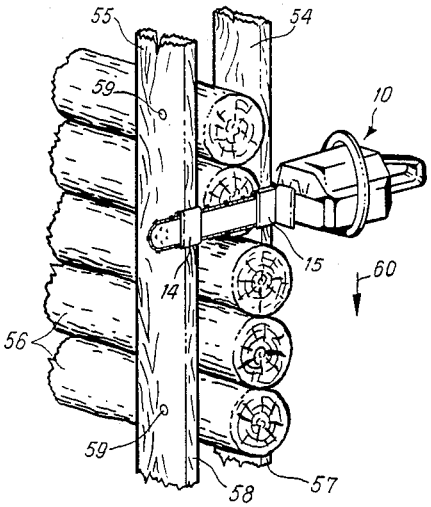
FIG. 5 is a perspective view of the chain saw and guide, with the guide plates shown in side engagement with the guide surfaces formed by wooden strips or the like positioned on opposite sides of the work product.

OPERATION As illustrated in FIG. 5, the chain saw and guide combination 10 can be used in combination with guide elements, such as boards 54 and 55 mounted on opposite sides of a work product 56, such as a wall formed from a plurality of stacked, horizontal logs. The boards 54 and 55 each include guide surfaces 57 and 58.

The boards are temporarily mounted to the work product 56 by double-headed nails 59 or other suitable mounting means. Typically, the boards 54 and 55 will be mounted with their flat guide surfaces 57 and 58 oriented in approximately the same plane and at the predetermined distance X (FIG. 4) away from the desired cut ends of the work product 56.

Once the boards 54 and 55 have been properly mounted to the work product, the chain saw and guide can be used to cut the protruding ends of the work product 56 in a common plane, by placing the side surfaces of the pairs of guide plates 14 and 15 against the flat guide surfaces 57 and 58 and then moving the chain saw in the direction as indicated by arrow 60 into the work product. By maintaining the guide plates in sliding abutment with the guide surfaces 57 and 58, the saw chain will cut the predetermined distance X away from the guide surfaces 57 and 58 through the work product 56, thereby forming a substantially perfect cut through the work product.

Figure 6:
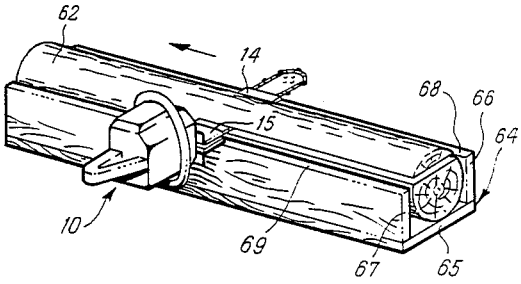
FIG. 6 is a perspective view of the chain saw and guide, show the saw being utilized to cut longitudinally along a log with the guide plates following the guide surfaces positioned on opposite sides of the log.

As illustrated in FIG. 6, the elongated log 62 is the work product, and the log is laid horizontally in a horizontally extending fixture trough 64. The fixture trough includes a bottom wall 65 and side walls 66 and 67, with the upper surfaces 68 and 69 of the side walls forming guide surfaces. When the chain saw and guide 10 is used in combination with the horizontal fixture trough 64, the pairs of guides plates 14 and 15 will abut the upper guide surfaces 68 and 69 so as to cause the saw chain to cut the log 62 at the predetermined distance X above the guide surfaces 68 and 69.

Figure 7:
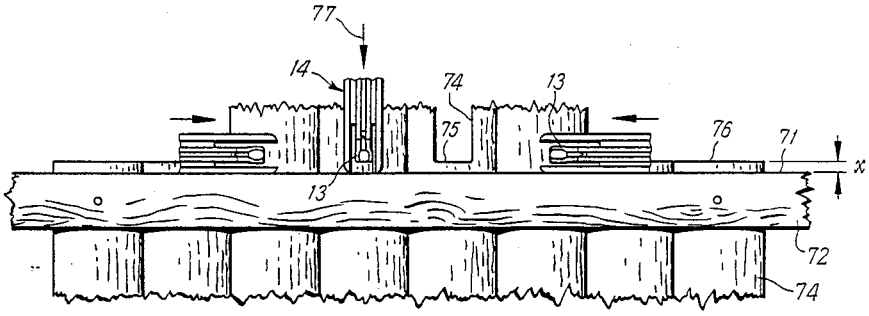
FIG. 7 is a schematic illustration of a portion of chain saws and guides as they are utilized in three attitudes, showing how the chain saw follows the shape of the guide surface.

As illustrated in FIG. 7, when the chain saw and guide combination are used in combination with a guide surface, such as the upper surfaces 71 of a pair of guide rails 72 (only one rail shown) positioned parallel to each other on opposite sides of the work product 74, the saw chain 13 will cut only to the predetermined distance X above the upper surfaces 71 of the guide rails no matter whether the chain saw is oriented with the saw chain oriented downwardly (center portion of FIG. 7) or to the right (left portion of FIG. 7) or to the left (right portion of FIG. 7). For example, when a vertical cut 74 is to be made, the saw will be oriented vertically and move downwardly as indicated by arrow 77. When the pairs of guide plates 14 and 15 engage the upper guiding surface 71 of the guide rail 72, the cut made by the saw chain 13 will reach only to a position 75, which is the dimension X from the upper surfaces 71 of the guide rails. Should the chain saw be oriented to cut to the left (right side of FIG. 7), the dimensions of the spacer plate and guide plate closest to the lower surfaces of the guide rails 72 again will permit the cut to be made at the level 76, which is the distance X from the upper surfaces of the guide rails 72. Likewise, when the chain saw is turned over to cut in the other direction, a similar cut is formed. Moreover, when the chain saw is moved into the work product and is operated in a fan like motion so that it is tilted between a vertical and a horizontal attitude, the rounded edge portions 46 and 47 tend to maintain the cutting path of the saw chain at a constant distance X from the guide surface 71 of the guide rail 72.

Figure 8:
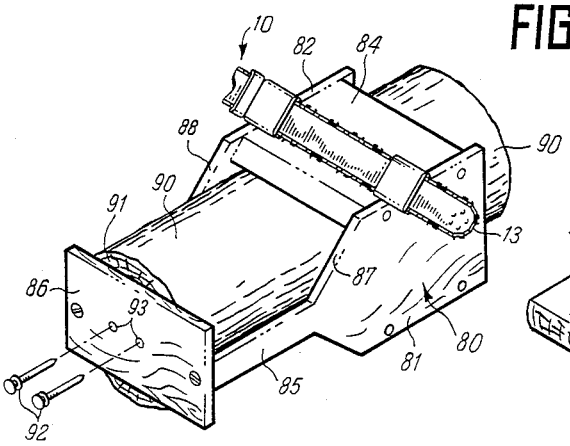
FIG. 8 is a perspective view of a guide fixture, the end of a log mounted in the guide fixture, and the portion of chain saw and guide as used in combination with the guide fixture to cut the log.

As illustrated in FIG. 8, other guide surfaces can be utilized in guiding the saw chain into a work product. For example, the fixture 80 comprises side panels 81 and 82, a bottom panel (not shown) and a top panel 84, side struts 85 (only one shown) extending forwardly from the side panels 81 and 82, and an end panel 86. The side panels 81 and 82 are tapered inwardly so as to form sloped guide surfaces, such as sloped surfaces 87 and 88 that slope downwardly from the top panel 84 to side struts 85 and upwardly from the bottom panel to the side struts. A log 90 is inserted into the fixture 80 until its end 91 abuts end panel 86, whereupon nails 92 are inserted through the openings 93 of the end wall 86 into the end of the log to hold the log steady during the following cutting operation.

Figure 9:
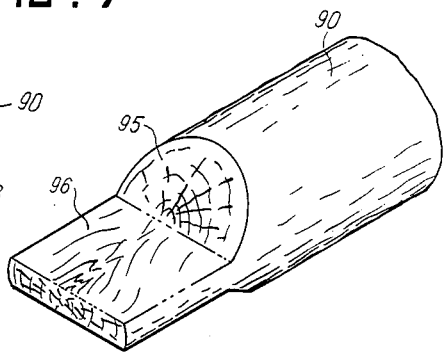
FIG. 9 is an illustration of the end portion of a log that has been cut by the chain saw and guide when the end of the log was mounted in guide fixture of FIG. 8.

The chain saw and guide are applied to the log 90 by moving the guide plates into contact with the sloped guide surfaces 87 and 88, so that the saw chain 13 forms a sloped cut 95 (FIG. 9) into the log. Once cut 95 has been formed, the chain saw will be withdrawn from the cut and the operator can make several vertical cuts into the log so as to remove the remaining material and eventually form the longitudinal cut 96.

After cuts 95 and 96 have been made on one side of the log, the log and its fixture 80 can be turned over and the same operation repeated on the opposite side of the log and fixture.

Figure 10:
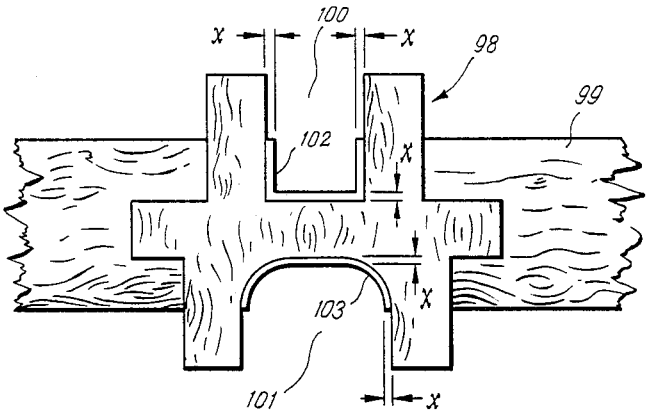
FIG. 10 is a side view of a fixture mounted on a work product, showing a right angle notch made in one side of the work product and, an arc cut made on the other side in the work product.

As illustrated in FIG. 10 of the drawings, the fixture 98 is mounted on a work product 99, with the fixture straddling the work product. In the upper portion of the fixture a rectangular notch 100 is formed, and in the lower portion of the fixture a U-shaped notch 101 is formed. The cut made by the saw follows the shape of the notch 100 or 101. However, the width of the notches 100 and 101 is not great enough to permit the saw to turn completely sideways within the notch. This requires the operator to tilt the saw back and forth in a fan or arc-shaped movement so as to form a notch 102 or 103, respectively, in the work product 99. By repeatedly tilting the saw back and forth within the notches, the desired cut will be made. As with the prior description, the cut formed in the work product is smaller than the guiding surfaces of the fixture by the dimensions X, as illustrated.

It will be noted that the guide plates 25, 26, 35 and 36 are of a length such that the guide plates protrude above both the lower and upper flights of the saw chain 13. Although the chain saw will be utilized most of the time with the bottom flight performing the cutting action, the upper flight of the saw chain can also perform a cutting action by simply lifting the chain saw upwardly toward the work product. The operator will have the ability to utilize the pairs of guide plates 14 and 15 when cutting with the upper flight of the saw chain, if desired.

The guide plates 25 and 26, 35 and 36 are spaced apart so as to form a slot adjacent the path of the saw chain, and the saw chain can be removed for repair or replacement without having to remove the guide plates, and wood chips from the cutting action of the saw chain are free to pass through the slot.

It should be understood that the embodiments of the invention disclosed herein illustrate principles of the invention in a preferred form. Other modifications, additions and deletions may be made thereto without departure from the spirit and scope of the invention as set forth in the following claims.

I claim:

1. A portable chain saw including a motor, a chain bar extending from said motor and a continuous saw chain extending about said chain bar in driven relationship with respect to said motor so that the motor moves the saw chain along a cutting path about said chain bar, the improvement therein of at least one pair of guide plates mounted to said chain bar with each guide plate of the pair of guide plates mounted on opposite sides of and in planes parallel to said chain bar, each guide plate including an edge portion protruding in overlying straddling relationship beyond the path of the saw chain and each of said edge portions having a curved guide surface extending parallel to the cutting path of the saw chain and spaced a predetermined constant radius (X) from the path of the saw chain whereby with the chain saw oriented in various attitudes and the curved guide surface of at least one of said guide paltes engaging a fixture guide surface the saw chain cuts the work product at a distance (X) displaced from the fixture guide surface.

2. The portable chain saw of claim 1 and wherein said pair of guide plates includes a guide plate positioned on each side of said chain bars and a spacer plate positioned between each guide plate and said chain bar, and connector means holding said guide plates and said spacer plates and said chain bar in abutting relationship.

3. The portable chain saw of claim 2 and wherein each of said spacer plates includes a spacer plate panel positioned between a guide plate and said chain bar and a fender panel extending at a right angle to said spacer panel away from said chain bar and beyond said guide plate.

4. The portable chain saw of claim 1 and wherein said at least one pair of guide plates comprises two pairs of guide plates mounted on said chain bar at positions spaced from each other so that each pair of guide plates can engage guides positioned on opposite sides of a work product and the saw chain can engage the work product as the saw chain moves from one pair of guide plates toward another pair of guide plates.

5. In combination with a chain saw including a chain bar, a saw chain extending about the periphery of said chain bar, power means for moving said saw chain in a cutting path about said chain bar, and guide means mounted to said chain bar and extending about the cutting path of the saw chain, said guide means having curved guide surfaces extending parallel to the cutting path and curved at a substantially constant radius (X) about said cutting path for engaging a guide member and guiding the movement of the chain saw as the saw chain cuts a work product positioned in the cutting path of the saw chain at a position displaced a predetermined distance (X) from the guide means.

6. The combination of claim 5 and wherein said guide means comprises a pair of guide plates each mounted on opposite sides of said chain bar and overlying said saw chain.

7. The combination of claim 6 and wherein said pair of guide plates both overlie the upper and lower flights of the saw chain on opposite edges of said chain bar.

8. A portable chain saw including a motor, a chain bar extending from said motor and a continuous saw chain extending about said chain bar in driving relationship with respect to said motor so that the motor moves the saw chain along a cutting path about said chain bar, the improvement therein of at least one pair of guide plates mounted to said chain bar with each guide plate of the pair of guide plates mounted on opposite sides of and in planes parallel to said chain bar and each guide plate including an edge portion protruding in overlying relationship and beyond the path of the saw chain, each of said guide plates including a guide plate positioned on each side of said chain bar and a spacer plate positioned between each guide plate and said chain bar, each of said spacer plates including a spacer plate panel positioned between a guide plate and said chain bar and a fender panel extending at a right angle to said spacer panel away from said chain bar and beyond said guide plate, and connector means holding said guide plates and said spacer plates and said chain bar in abutting relationship, whereby the guide plates can engage a guide surface and guide the movement of the chain saw as the saw chain cuts a work product positioned in the path of the saw chain at a position displaced from the guide plates.

* * * * *